US005958286A

United States Patent [19]

Kitanaka

[11] Patent Number: 5,958,286

[45] Date of Patent: Sep. 28, 1999

[54] AUTOMATIC TRANSMISSION FLUID COMPOSITION

[75] Inventor: Masanobu Kitanaka, Yokohama, Japan

[73] Assignee: Nippon Oil Company, Ltd., Japan

[21] Appl. No.: 07/980,637

[22] Filed: Nov. 24, 1992

[30] Foreign Application Priority Data

Nov. 27, 1991 [JP] Japan ..... 3-335864

[51] Int. Cl.[6] ..... C10M 159/20

[52] U.S. Cl. ..... 252/74; 252/77; 508/186; 508/287; 508/545; 508/555; 508/563

[58] Field of Search ..... 252/18, 78.1, 74

[56] References Cited

U.S. PATENT DOCUMENTS 3,853,772 12/1974 Adams ..... 252/18
3,897,350 7/1975 Heiba et al. ..... 252/74

FOREIGN PATENT DOCUMENTS 0407124 1/1991 European Pat. Off. .
0447916 9/1991 European Pat. Off. .
8804684 6/1988 WIPO .
9109922 7/1991 WIPO .

*Primary Examiner*—Ellen M. McAvoy
*Attorney, Agent, or Firm*—Ostrolenk, Faber, Gerb & Soffen, LLP

[57] ABSTRACT

An automatic transmission fluid composition is provided which has significantly higher coefficients of dynamic friction ($\mu$d) and static friction ($\mu$s) than those of the conventional automatic transmission fluid. In addition, the composition has a $\mu$o/$\mu$d ratio close to 1.0, and a small change with the passage of time in frictional properties. The automatic transmission fluid composition comprises 0.01 to 20% by weight of an overbasic oil-soluble metal salt (a) prepared by use of an alkaline-earth metal borate, and 0.01 to 15% by weight of a compound (b) having a long-chain alkyl group and an amino group in the same molecular structure on the basis of the total amount of composition as essential components, the balance being lubricating base oil.

6 Claims, No Drawings

AUTOMATIC TRANSMISSION FLUID COMPOSITION

BACKGROUND OF THE INVENTION

1. Field of the Invention

This invention relates to an automatic transmission fluid composition, and more particularly to an automatic transmission fluid composition which is excellent in shift feeling as well as prevention of slip after contacting the clutch, and in addition which has a short shift time and a very small change in the friction coefficient during use.

2. Background Art

An automatic transmission is a transmission having a mechanism in which the transmission torque ratio is automatically established in response to the speed of the car, magnitude of load or the like. Such an automatic transmission comprises a torque converter part, a multiple disk clutch, a planetary gear part, and a hydraulic controlling part. The automatic transmission fluid is a common lubricating oil for all the parts described above, and which functions as a transfer fluid for motive power, as a lubricating oil for gears and bearings, and as a hydraulic fluid for controlling devices.

A shift operation wherein various reduction gear ratios are attained by changing the connections between the respective members of planetary gears is carried out by utilizing clutches and a braking band. At the present time, the general type of clutch is a wet clutch composed of a multiple disk clutch comprising a driven plate of steel and a drive plate of a paper frictional material. The frictional properties of such a wet clutch greatly influence the transmitting function of the automatic transmission unit, and in turn, the shift feeling of the motorcar.

While frictional properties of the wet clutch change depending upon the combination of the paper frictional material being the drive plate and the automatic transmission fluid, the influence due to composition of the automatic transmission fluid is remarkable; therefore, in recent years, in view of smoother shift feeling, there is a tendency to lay stress on the frictional properties of automatic transmission fluid in wet clutch, and a need exists for an automatic transmission fluid having good frictional characteristics.

Such frictional properties are evaluated by a SAE No. 2 friction tester, which is well known by those skilled in the art. This type of tester is essentially an inertia dynamometer wherein the kinetic energy of a rotor is spent by a frictional plate, and a coefficient ($\mu$) of friction is calculated from the friction torque.

As methods for measuring coefficient of friction, there are the dynamic method and the static method. The dynamic method is effected in such a manner that an inertia plate (mounted on a motor shaft) is rotated at a high speed by means of a motor for a given period of time, thereafter the motor power supply is shut off, and at the same time pneumatic pressure is applied to a piston, whereby the driven plate is pressed against the drive plate which has been rotated integrally with the motor shaft to stop the movement of the inertia plate. A dynamic friction coefficient ($\mu d$) at the time of rotating the motor is obtained from the friction torque curve in the above case. Furthermore a friction coefficient at the end of clutch engaging ($\mu o$) is obtained from the friction torque immediately before the stop.

In the static method, the friction torque produced by a facing up of the drive plate and the driven plate is obtained by rotating the inertia plate by means of an auxiliary motor at a very low speed while applying pneumatic pressure to the piston. The static breakaway friction coefficient ($\mu s$) is calculated from the value obtained as described above.

In general, a larger value of $\mu d$ is desired for a short shift time, and a larger value of $\mu s$ is desired for more effective prevention of slip after contacting the clutch. On the other hand, a value of $\mu o/\mu d$ closer to 1.0 provides a smoother shift feeling, and is thus desirable. In recent years, there has been a demand for an automatic transmission fluid having a much higher value of both the coefficients of friction ($\mu d$ and $\mu s$) because such a fluid leads to motorcars equipped with lightweight and small-sized transmission clutches, and such cars will give better fuel economy.

However, presently available automatic transmission fluids are less than satisfactory for good frictional properties.

SUMMARY OF THE INVENTION

One object of the present invention is to provide an automatic transmission fluid composition wherein both the coefficients of friction ($\mu d$ and $\mu s$) are much higher than those of the conventional automatic transmission fluid composition, the ratio ($\mu o/\mu d$) of the coefficient of friction at the end of clutch engaging to the coefficient of dynamic friction is close to 1, and besides there is a very small change in both friction coefficients during use of the composition.

Another object of the present invention is to provide an automatic transmission fluid composition comprising 0.01 to 20% by weight of an overbasic oil-soluble metal salt (a) prepared by use of an alkaline-earth metal borate, and 0.01 to 15% by weight of a compound (b) having a long-chain alkyl group and an amino group in the same molecular structure, on the basis of the total amount of composition as essential components, the balance being lubricating base oil.

Either mineral oils or synthetic oils may be used as the lubricating base oils in the present invention. Any paraffinic or naphthenic lubricating base oils, which have been used in a conventional automatic transmission fluid, are acceptable. Such lubricating base oils are usually manufactured by a process comprising topping crude oil followed by vacuum distillation, and refining the resulting lubricating oil fraction by a method selected from the group consisting of solvent deasphalting, solvent extraction, hydro-cracking, solvent-dewaxing, catalytic-dewaxing, hydro-refining, sulfuric acid treating, clay treating and the like.

Typical examples of the synthetic oils include poly-$\alpha$-olefins such as polybutenes, octene-1 oligomers, decene-1 oligomers and the like; alkylbenzenes; alkylnaphthalenes; diesters such as ditridecyl glutarate, di-2-ethylhexyl adipate, diisodecyl adipate, ditridecyl adipate, di-3-ethylhexyl sebacate and the like; polyol esters such as trimethylolpropane caprylate, trimethylolpropane pelargonate, pentaerythritol 2-ethylhexanoate, pentaerythritol pelargonate and the like; polyoxyalkylene glycols; polyphenyl ethers; silicon oils; perfluoroalkyl ethers and the like.

As for these base oils, it is possible to use any single material or admixture consisting of two or more components which satisfy a kinematic viscosity of 1 to 10 cst, preferably 2 to 6 cst at 100° C.

The overbasic oil-soluble metal salts (a) according to the present invention, which is prepared by use of an alkaline-earth metal borate, can be obtained by a reaction of an oil-soluble metal salt such as an oil-soluble alkaline-earth metal sulfonate, alkaline-earth metal salicylate, alkaline-earth metal phenate and alkaline-earth metal phosphonate and the like with an oxide or hydroxide of an alkaline-earth metal in the presence of boric acid or boric acid anhydride.

Examples of the alkaline-earth metal include magnesium, calcium, barium and the like, with calcium being preferred.

Among the oil-soluble metal salts, an alkaline-earth metal sulfonate is preferable in view of the good improving effects on frictional properties.

Further, it is preferable to use an overbasic oil-soluble metal salt (a) which has a base number of 100 or more, and preferably 150 or more according to the method as provided by JIS K 2501 5.2.3. Particle size of the overbasic metal salt is 0.1 μm or less, and preferably 0.05 μm or less.

Any methods for the preparation of the overbasic oil-soluble metal salts (a) obtained by use of an alkaline-earth metal borate may be employed. For example, the overbasic oil-soluble metal salts can be obtained by using a method which comprises reacting an oil-soluble metal salt aforesaid, a hydroxide or an oxide of alkaline-earth metal, and boric acid or boric acid anhydride in the presence of water; an alcohol such as methanol, ethanol, propanol or butanol; and a diluent such as benzene, toluene or xylene at a temperature of 20 to 200° C. for 2 to 8 hours, heating the mixture to 100 to 200° C. to remove water, and removing optionally the alcohol and the diluent to thereby provide an overbasic oil-soluble metal salt. The reaction conditions may be set suitably according to the raw materials employed, the amount of reactants and the like. Typical of such prior art practices are those disclosed in Japanese Patent Provisional Publication No.s 116688/60, 204298/61 and 68695/H3, and the disclosures of which are incorporated by reference.

The overbasic oil-soluble metal salt (a) thus obtained has usually a particle size of 0.1 μm or less, and a total base number of 100 or more, and is thus preferable.

The content of overbasic oil-soluble metal salt (a), which is prepared by use of an alkaline-earth metal borate may range from 0.01 to 20% by weight, preferably 0.05 to 5% by weight on the basis of the total amount of composition. When the content is less than about 0.01% by weight, the improvement effect of frictional properties is insufficient. Inversely, when the content is in excess of about 20% by weight, no additional merits can be obtained. Also when another overbasic oil-soluble metal salt such as those prepared by use of an alkaline-earth metal carbonate is employed instead of component (a), the composition cannot provide useful frictional properties.

Examples of the compound used as component (b), which has a long-chain alkyl group and an amino group in the same molecular structure, include succinimides and derivatives thereof, benzylamines, polyalkenylamines, and polyoxyalkylene aminoamides.

Typical succinimides or derivatives thereof are those prepared by a method comprising reacting a polyolefin such as polybutenes having a molecular weight of 300 to 3000 with maleic anhydride, imidating the resulting product with a polyamine such as tetraethylenepentamine, and optionally amidating a part of the residual amino groups of the resulting imide compound with an aromatic polycarboxylic acid such as phthalic acid, trimellitic acid, pyromellitic acid. The product thus obtained may be further modified with boric acid.

In the imidation, two types of imide compounds can be obtained, one of which is the so-called "mono-type" wherein one end of the polyamine molecular chain is occupied by maleic anhydride moiety, and the other is "bis-type" wherein both ends of the polyamine molecular chain are occupied by maleic anhydride moieties.

Examples of the benzylamines include those prepared by the Mannich reaction in which a polyolefin such as propylene oligomers or polybutenes having a molecular weight of 300 to 3000 is reacted with phenol, and the resulting alkylphenol is further reacted with formaldehyde and a polyamine to thereby provide a benzylamine.

Examples of the polyalkenylamine include those prepared by a method comprising chlorinating a polyolefin such as polybutenes having a molecular weight of 300 to 3000, and then reacting the product with ammonium or a polyamine to give a polyalkenylamine.

The amount of component (b), which has a long-chain alkyl group and an amino group in the same molecular structure, may range from 0.01 to 15% by weight, preferably 0.05 to 10% by weight on the basis of the total amount of composition. When the content is less than about 0.01% by weight, the composition only exhibits good frictional properties for a short period of time. Inversely, when it is in excess of about 15% by weight, no additional merits can be obtained.

In the automatic transmission fluid composition according to the present invention, conventional additives may arbitrarily be employed to further enhance the performances.

Examples of such additives include metallic detergents such as other alkaline-earth metal sulfonates other than those used as component (a) of the present invention, alkaline-earth metal phenates, phosphonates, carboxylates, salicylates and the like; antioxidants such as zinc alkyl or aryl dithiophosphates, hindered phenols, aromatic amines and the like; extreme pressure agents such as olefin sulfides, ester sulfides, phosphoric esters, phosphorus esters and the like; friction modifiers such as fatty acids, salts and esters of a fatty acid, higher alcohols, acid phosphoric esters, amine compounds and the like; metal deactivators; rust preventives; viscosity index improvers; pour point depressants; seal swelling agents; defoaming agents and mixtures thereof.

The viscosity index improver, defoaming agent, metal deactivator, and other additives may usually be present in the composition in amounts of from 1 to 30% by weight, from 0.0001 to 1% by weight, 0.005 to 1% by weight, and 0.1 to 15% by weight respectively, on the basis of the total amount of composition.

While the advantages of the composition according to the present invention will be described in detail hereinbelow in conjunction with the following examples, it is to be noted that the scope of the present invention should not be limited to these examples.

DETAILED DESCRIPTION OF THE PREFERRED EMBODIMENTS

EXAMPLES 1 TO 6 AND COMPARATIVE EXAMPLES 1 TO 5

According to the composition indicated in Table 1, the automatic transmission fluid compositions of the present invention were prepared. Frictional properties (μd, μs, μo/μd) were measured at 500 cycles-hour and 10000 cycles-hour with respect to these compositions by means of SAE No.2 friction tester (with the use of commercially available paper frictional materials), and the results thereof are shown in Table 2.

For the comparison, frictional properties were also measured with respect to the compositions prepared in accordance with the composition indicated in Table 1 wherein no component (a) is used (comparative Example 1), no component (b) is used (Comparative Example 2), a calcium sulfonate neutral salt instead of component (a) is used (Comparative Example 3), an overbasic calcium sulfonate which has been prepared by use of calcium carbonate is used instead of component (a) (Comparative Example 4) and a commercially available automatic transmission fluid composition is used (Comparative Example 5), and the results thereof are shown in Table 2.

TABLE 1

| | | Example 1 | Example 2 | Example 3 | Example 4 | Example 5 | Example 6 |
|---|---|---|---|---|---|---|---|
| Component (a)[1] [Wt. %] | | Ca-sulfonate (Base No. 180) [2.0] | Ca-sulfonate (Base No. 180) [0.5] | Ca-sulfonate (Base No. 180) [3.0] | Ca-phenate (Base No. 200) [1.5] | Ca-salicylate (base No. 200) [1.5] | Ca-sulfonate (Base No. 180) [2.0] |
| Component (b) | | Alkenyl Succinimide (MW = 2100) [4.0] | Alkenyl Succinimide (MW = 2200) [5.0] | Benzylamine (MW = 1200) [2.0] | Alkenyl Succinimide (MW = 2100) [1.0] | Polybutenyl Polyamine (MW = 1500) [4.0] | Alkenyl Succinimide (MW = 2100) [3.0] |
| Other Additives[2] | | [10.0] | [10.0] | [10.0] | [10.0] | [10.0] | [10.0] |
| Base Oil (4.3 cSt 100° C.) | | Refined Mineral Oil [84.0] | Refined Mineral Oil [84.5] | Refined Mineral Oil [85.0] | Refined Mineral Oil [87.5] | Refined Mineral Oil [84.5] | Poly-α-olefin Oil + Diester Oil [85.0] |
| μd | 500 | 0155 | 0.152 | 0.150 | 0.151 | 0.155 | 0.156 |
| μs | cycles | 0.142 | 0.145 | 0.144 | 0.138 | 0.142 | 0.143 |
| μo/μd | | 1.05 | 1.09 | 1.07 | 1.03 | 1.05 | 1.09 |
| μd | 10000 | 0.175 | 0.153 | 0.152 | 0151 | 0.151 | 0.154 |
| μs | cycles | 0.143 | 0.143 | 0.142 | 0.139 | 0.139 | 0.141 |
| μo/μd | | 1.03 | 1.08 | 1.05 | 1.00 | 0.02 | 1.06 |

[1]Overbasic type, by use of Ca-borate
[2]Antioxidants, Wear preventives, Metal deactivators, VI improvers etc.

TABLE 2

| | | Comp. Expl. 1 | Comp. Expl. 2 | Comp. Expl. 3 | Comp. Expl. 4 | Comp. Expl. 5 |
|---|---|---|---|---|---|---|
| Component (a) [Wt. %] | | — | Ca-sulfonate[1] (Base No. 180) [2.0] | Ca-sulfonate[3] (Base No. 0) [2.0] | Ca-sulfonate[4] (Base No. 200) [2.0] | Commercially available transmission fluid |
| Component (b) | | Alkenyl Succinimide (MW = 2100) [4.0] | — | Alkenyl succinimide (MV = 2100) [4.0] | Alkenyl Succinimide (MW = 2100) [4.0] | |
| Other Addltives[2] | | [10.0] | [10.0] | [10.0] | [10.0] | |
| Base Oil (4.3 cSt 100° C.) | | Refined Mineral Oil [86.0] | Refined Mineral Oil [88.0] | Refined Mineral Oil [84.0] | Refined Mineral Oil [84.0] | |
| μd | 500 | 0.144 | 0.157 | 0.139 | 0.143 | 0.136 |
| μs | cycles | 0.158 | 0.144 | 0.139 | 0.133 | 0.122 |
| μo/μd | | 1.18 | 1.05 | 1.12 | 1.17 | 1.06 |
| μd | 10000 | 0.137 | 0.140 | 0.135 | 0.141 | 0.139 |
| μs | cycles | 0.166 | 0.181 | 0.124 | 0.131 | 0.127 |
| μo/μd | | 1.27 | 1.18 | 1.17 | 1.14 | 0.05 |

[1]Overbasic type, by use of Ca-borate
[2]The same as shown in Table 1 (Antioxidants, Wear preventives, Metal deactivators, VI improvers etc.)
[3]Neutral salt [4]Overbasic type, by use of Ca-carbonate As is apparent from the results of the frictional properties as shown in Tables 1 and 2, the automatic transmission fluid compositions of Examples 1 to 6 according to the present invention have high coefficients of dynamic friction (μd) and static breakaway friction (μs), moreover, the ratio (μo/μd) of the coefficient of friction at the end of clutch engaging to the coefficient of dynamic friction is close to 1.0. As a result, these compositions have characteristics useful for an automatic transmission fluid. In addition, the difference between these coefficients measured at 200 cycles-hour and at 10000 cycles-hour respectively is very small; therefore, it is also apparent that the frictional properties of these compositions according to the present invention are also useful in that they do not change largely with time during use.

On the contrary, when the composition of Comparative Example 1 in which no component (a) is used is compared with the corresponding composition of Example 1, the μd decreases and the ratio μo/μd increases. The frictional properties are also inferior to those of the composition of the present invention in that they change largely with time during use.

When the composition of Comparative Example 1 in which no component (b) is used is compared with the corresponding composition of Example 1, their frictional properties measured at 500 cycles-hour are nearly equal; however, the frictional properties measured at 10,000 cycles-hour is significantly impaired, showing that the frictional properties are inferior to those of the composition of the present invention in that they change largely with time during use.

When the composition of Comparative Example 3 or 4, in which a neutral calcium sulfonate or an overbasic calcium sulfonate prepared by use of calcium carbonate is used respectively, is compared with the corresponding composition of Example 1, both the μd and μs decrease and the ratio μo/μd increases, showing that these compositions are inferior to the composition of Example 1 in all the frictional properties.

On the other hand, the commercially available composition of Comparative Example 5 shows a $\mu o/\mu d$ ratio and a change with time in frictional properties comparable with those of the composition of the present invention; however, the values of $\mu d$ and $\mu s$ decrease considerably.

As described above, effects of adding component (a) with component (b) are clear, and it is apparent that only the compositions according to the present invention exhibit particularly superior performance.

What is claimed is:

1. A method for the lubrication of an automatic transmission of a motorcar which comprises lubricating the automatic transmission with an automatic transmission fluid comprising, on the basis of the total amount of composition, as essential components, 0.01 to 20% by weight of an overbasic oil-soluble metal salt (a) prepared by use of an alkaline-earth metal borate, and 0.01 to 15% by weight of a compound (b) derived from a polyolelfin having a molecular weight of 300 to 3000, said compound (b) having a long-chain alkyl group and an amino group in the same molecular structure selected from the group consisting of succinimide and derivatives thereof, benzylamine, polyalkylamine, and polyoxyalkylane aminoamide, the balance being lubricating base oil.

2. A method for the lubrication of an automatic transmission of a motorcar according to claim 1, wherein the amount of said overbasic oil-soluble metal salt (a) is 0.05 to 5% by weight and the amount of said compound (b) is 0.05 to 10% by weight.

3. A method for the lubrication of an automatic transmission of a motorcar according to claim 1, wherein said overbasic oil-soluble metal salt (a) is the reaction product of an oil-soluble metal salt selected from the group consisting of an oil-soluble alkaline-earth metal sulfonate, alkaline-earth metal salicylate, alkaline-earth metal phenate and alkaline-earth metal phosphorate with an oxide or hydroxide of an alkaline-earth metal in the presence of boric acid or boric acid anhydride.

4. A method for the lubrication of an automatic transmission of a motorcar according to claim 1, wherein said lubricating base oil has a kinematic viscosity of 1 to 10 cSt at 100° C.

5. A method for the lubrication of an automatic transmission of a motorcar according to claim 4, the amount of overbasic oil-soluble metal salt (a) is 0.05 to 5% and the amount of compound (b) is 0.05 to 10% and said overbasic oil-soluble metal salt (a) is the reaction product of an oil-soluble metal salt selected from the group consisting of an oil-soluble alkaline-earth metal sulfonate, alkaline-earth metal salicylate, alkaline-earth metal phenate and alkaline-earth metal phosphorate with an oxide or hydroxide of an alkaline-earth metal in the presence of boric acid or boric acid anhydride.

6. A method for the lubrication of an automatic transmission of a motorcar according to claim 5, wherein said lubricating base oil has a kinematic viscosity of 226 cSt at 100° C. and said overbasic oil-soluble metal salt is the reaction product of an oil-soluble calcium sulfonate and an oxide or hydroxide of calcium in the presence of boric acid or boric acid anhydride.

* * * * *